United States Patent [19]

Ervine

[11] 4,302,038

[45] Nov. 24, 1981

[54] LOCKING ASSEMBLY

[76] Inventor: William J. Ervine, 521 Terry Ave., Billings, Mont. 59101

[21] Appl. No.: 82,544

[22] Filed: Oct. 9, 1979

Related U.S. Application Data

[63] Continuation-in-part of Ser. No. 876,636, Feb. 10, 1978, abandoned.

[51] Int. Cl.[3] ..... E05C 17/32

[52] U.S. Cl. ..... 292/263; 292/DIG. 46

[58] Field of Search ..... 292/262, 263, 288, 289, 292/338, 339, DIG. 46, 277, DIG. 49; 49/449

[56] References Cited

U.S. PATENT DOCUMENTS

| | | | |
|---|---|---|---|
| 2,361,403 | 10/1944 | Kabot | 292/277 X |
| 2,894,295 | 7/1959 | Singleton | 292/263 X |
| 3,499,675 | 3/1970 | Isenberg | 292/263 |
| 3,698,754 | 10/1972 | Means | 292/DIG. 46 X |
| 3,825,290 | 7/1974 | Messina et al. | 292/262 |
| 3,873,142 | 3/1975 | Reid | 292/DIG. 49 X |

FOREIGN PATENT DOCUMENTS

| | | | |
|---|---|---|---|
| 1052859 | 3/1959 | Fed. Rep. of Germany | 292/263 |
| 104040 | 3/1942 | Sweden | 292/263 |

*Primary Examiner*—William E. Lyddane
*Attorney, Agent, or Firm*—Arthur L. Urban

[57] ABSTRACT

A locking assembly for a sliding door or window including an angle member disposed with one flange section in a horizontal position normally and a second flange section extending downwardly therefrom in a vertical plane, a pair of rigid elongated bars connected to the second flange section below the first flange section with at least one being pivotally connected, the elongated bars being disposed normally in a horizontal position aligned longitudinally of each other with their adjacent ends spaced horizontally along the second flange section, mounting brackets pivotally attached to the free ends of the elongated bars, and means positionable between the angle member and the pivotally connected elongated bar selectively to prevent the elongated bars from being oriented in a longitudinally aligned locked position.

8 Claims, 5 Drawing Figures

LOCKING ASSEMBLY

This application is a continuation-in-part of application Ser. No. 876,636, filed Feb. 10, 1978, now abandoned.

This invention relates to a novel locking assembly and more particularly relates to a new locking assembly for sliding doors and windows.

Sliding windows and patio doors have become very popular in recent years. Generally, these doors and windows have two panels with large panes of glass surrounded by metal or wooden frames. The panels are mounted on parallel tracks so that one panel can be slid into an overlying relationship with the other. This opens one side of the door for access through the door opening. The door is closed by returning the movable panel to its original position alongside the other panel with only the adjacent edges of their frames overlapping. Sliding doors and windows generally are of similar construction and operation.

Although sliding doors and windows are popular because of the large expanse of glass they provide, this feature also creates a very serious problem, that is, preventing unauthorized entry. Since the frames of the panels are narrow, there is little space for the locking mechanisms. Because of the space limitation, the locks used on sliding doors and windows generally have been flimsy and easy to force.

Manufacturers of sliding doors and windows now are providing locks for their products which are more sturdy and more resistant to forcing or jimmying. However, such locks because of the space limitations, still do not provide the protection afforded by well designed locks for hinged doors. The new locks being offered on sliding doors and windows also add considerably to the cost thereof.

While these recent improvements in sliding door and window locks may provide additional protection for owners of new homes, the improvements do not afford any added protection for the millions of owners of older homes and occupants of older apartments which have sliding doors and windows with flimsy locks.

Police and other law enforcement agencies have suggested that broomsticks or other poles be laid in the track of the movable panel of a sliding door or window. The stick is cut to a length which will cover the visible portion of the track when the door is closed. The use of a broomstick does prevent forcing of a sliding door or window when properly used, but it is not considered a desirable solution to the problem. For example, a stick cannot be used with doors and windows in which the movable panel slides to the outside of the fixed panel. Although most sliding doors and windows are designed with the movable panel sliding to the inside of the fixed panel, there are a sizeable number of units which reverse the arrangement.

Another problem inherent in the use of broomsticks is the nuisance of stooping to remove the stick each time the door is to be opened. A further drawback is the high degree of diligence required to ensure that the stick is replaced each time after the door is used. Also, the person leaving through the door cannot replace the stick from the outside so a second person is required to replace the stick and provide the protection desired. In addition, the broomstick is unsightly and does not blend with the decor of the door.

The present invention provides a novel locking assembly for a sliding door or window, which assembly can be installed conveniently by a homeowner. Also, the locking assembly of the invention can be installed permanently at the factory during the fabrication of the unit. Furthermore, the locking assembly does not have to be removed from the door each time it is used. The locking assembly always is in locking position unless affirmative action is taken to unlock the door. In addition, the locking assembly of the invention can be installed at any convenient height which eliminates stooping and permits placement away from the hands of children.

Another advantage of the locking assembly of the present invention is that the door will be locked automatically after it is closed, whether the door is closed from the inside or from the outside. Also, the locking assembly can be fabricated from available components relatively inexpensively. Moreover, the locking assembly can be fabricated of materials which are similar in appearance to those of the door or window to blend with their decor. Further, the locking assembly is simple in design and can be installed in a few minutes without special skills or tools. In addition, the locking assembly can be used with units having panels which slide to the outside of the fixed panel and with units in which both panels are movable.

Other benefits and advantages of the novel locking assembly of the invention will be apparent from the following description and the accompanying drawings which illustrate the invention in greater detail.

FIG. 1 of the drawings is a side elevation of a sliding door with one form of the novel locking assembly of the present invention;

Figure 1:
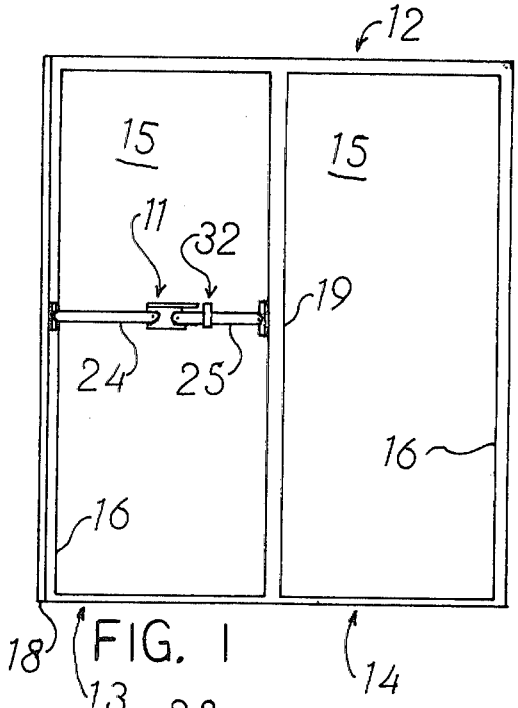

As shown in the drawings, one form of the novel locking assembly 11 of the present invention is affixed to a sliding door 12 having a fixed panel 13 and a movable panel 14. Each panel 13 and 14 has a glass pane 15 and a metal or wooden frame 16. One end of locking assembly 11 is affixed to door jam 18 at the outer edge of fixed panel 13 and the other end thereof the edge 19 of movable panel 14 which is closest to jam 18.

Locking assembly 11 includes an angle member 21 which is disposed with one flange section 22 thereof in a horizontal position normally and a second flange section 23 extending downwardly from flange section 22 in a vertical plane. Advantageously, the larger dimension of each flange section 22 and 23 is along their common edge with the adjacent section.

A pair of rigid elongated bars 24 and 25 is connected to flange section 23 below flange section 22. Bars 24 and 25 are disposed normally in a horizontal position aligned longitudinally of each other. The adjacent ends of bars 24 and 25 are spaced horizontally along flange section 23. At least one of the adjacent ends of bars is pivotally connected to flange section 23. Preferably, as shown in the drawings, the adjacent ends of both bar 24 and bar 25 are pivotally connected to flange section 23.

These connections may be achieved with pins 26 or similar fasteners.

The outer ends of bars 24 and 25 are pivotally connected to mounting brackets 28 and 29, respectively, with pins 30. Mounting brackets 28 and 29 may be of any suitable configuration which allows bars 24 and 25 to pivot easily with respect thereto. Advantageously, brackets 28 and 29 are angle brackets with flange sections disposed in vertical planes.

Bars 24 and 25 preferably are rectangular in cross section with the larger dimension parallel to flange section 23 of angle member 21. As pointed out above, the bars should be rigid to provide structural integrity to the locking assembly. The bars as well as the other components of the locking assembly may be fabricated of steel, aluminum, wood, plastic and combinations thereof to blend with the decor of the door or window and the room in which it is located.

Figure 4:
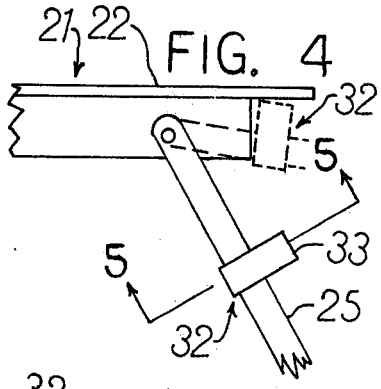
FIG. 4 is a further enlarged fragmentary side view of the anti-locking member of the locking assembly shown in FIG. 1.
Figure 5:
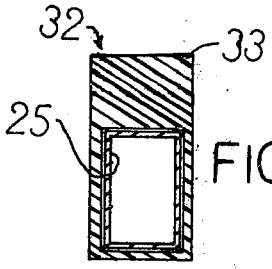
FIG. 5 is a sectional view taken along line 5—5 of FIG. 4.
Figure 2:
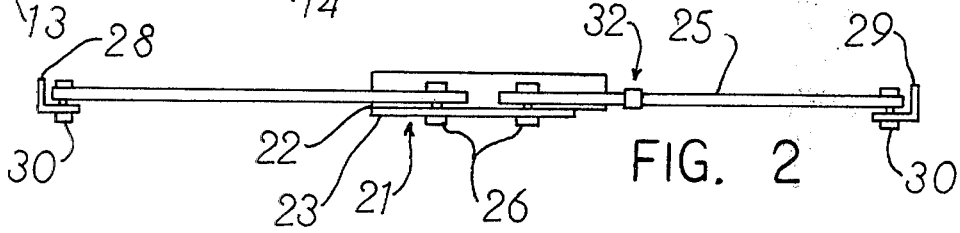
FIG. 2 is an enlarged view from below of the locking assembly shown in FIG. 1.
Figure 3:
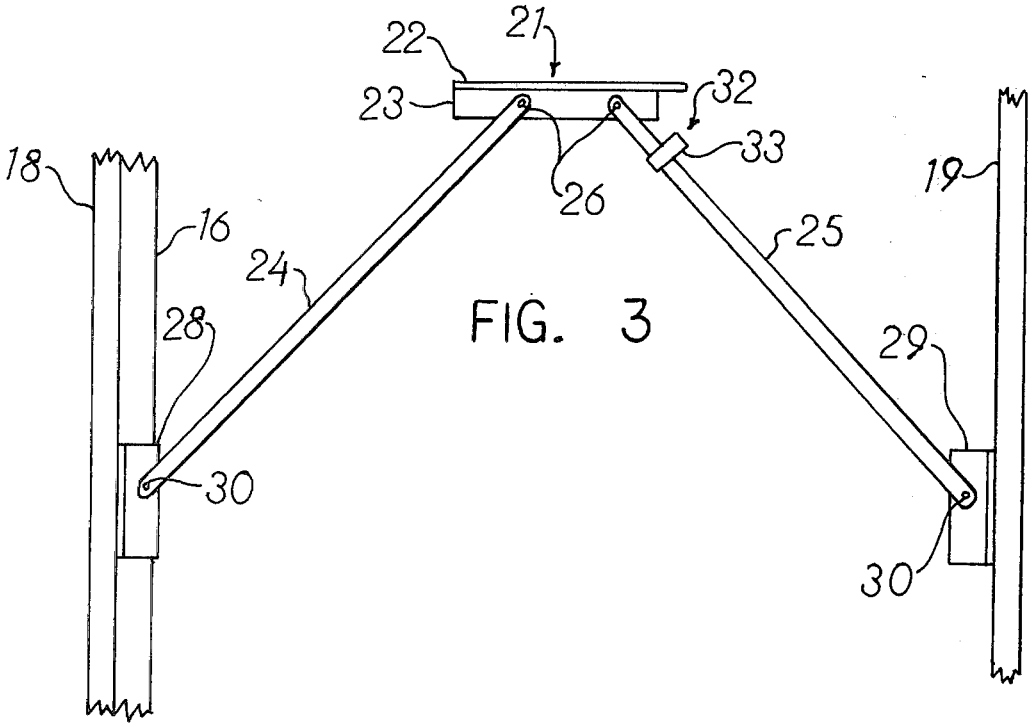
FIG. 3 is an enlarged side elevation of the locking assembly of FIG. 1 shown when the door is partially open.

The locking assembly 11 of the invention also includes means for preventing the assembly from being positioned in a locked position. The lock-preventing means is selectively positionable between angle member 21 and the bar pivotally connected thereto. FIGS. 4 and 5 illustrate one form of such anti-locking means as a loop member 32 which is slidably disposed on bar 25. Loop member 32 has an enlarged top section 33. When bar 25 is at an angle to flange section 22, top section 33 of loop member 32 can be slid into the space between the bottom of flange section 22 and the top of bar 25. Advantageously, the loop member 32 fits tightly on bar 25 so there is sufficient friction therebetween to maintain the position of the loop member on the bar.

The locking assembly of the present invention as shown in the drawings is mounted on a door 12 by securing mounting bracket 28 to jam 18 and securing mounting bracket 29 to edge 19 of movable panel 14. The locking assembly 11 is mounted so that bars 24 and 25 are in a horizontal position. To achieve this condition, it may be necessary to shorten bars 24 and 25. This can be accomplished by cutting off one end of each bar and reconnecting the bar to the mounting bracket or the angle member.

When bars 24 and 25 are in a horizontal and longitudinally aligned position, the door is locked and the locking assembly is functioning properly. To open the door with the locking assembly in this position, flange section 22 is raised slightly to move bars 24 and 25 from their longitudinally aligned position. Simultaneously, the movable panel 14 is pulled toward the right. After panel 14 has moved a short distance, flange section 22 can be released and the movement of panel 14 continued. When the door 12 is closed again, the bars 24 and 25 will return to a horizontal and longitudinally aligned position and the door will be locked by locking assembly 11. This locking action takes place automatically after the door is closed without any affirmative action on the part of the person using the door.

During the opening and closing of the door, the bars 24 and 25 move from a horizontal position in which the bars are longitudinally aligned to a position in which they are at an angle to one another. This is accomplished by the pivoting action of the bars 24 and 25 at their connections with mounting brackets 28 and 29 and by the pivoting action of the bars at their connections with angle member 21. As the angle between bars 24 and 25 decreases, angle member 21 will move upwardly.

If it is desired that the locking assembly 11 not function when the door is in a closed position, flange section 22 is raised slightly to move bars 24 and 25 from their longitudinally aligned position into a slightly angled position. At the same time, top section 33 of loop member 32 which is disposed on bar 25 is slid into the space between the bottom of section 22 and the top of bar 25. In this condition, the door 12 can be opened and closed as if the locking assembly 11 was not present. However, in this condition, locking assembly 11 does not provide any protection against unauthorized entry. To activate the locking assembly, it is only necessary to slide loop member 32 away from contact with flange section 22 allowing the bars 24 and 25 to return to a longitudinally aligned position. Thereafter, the locking assembly 11 functions again in the intended manner for which it was designed.

The above description and the accompanying drawings show that the present invention provides a novel locking assembly for a sliding door or window. The locking assembly does not have to be removed each time the door is used but may be permanently installed either at the factory or by a homeowner on an existing door or window. The locking assembly can be installed in a few minutes without special tools or skills. The locking assembly of the invention can be installed at any convenient height to eliminate stooping. Also, the locking assembly can be placed high enough to be out of the reach of small children. Further, the locking assembly is suitable for use on units in which the movable panel slides to the outside of the fixed panel and those in which both panels are movable, as well as the more common design in which the sliding panel moves to the inside of the fixed panel.

Another advantage of the locking assembly of the present invention is the simplicity of its design and that it can be fabricated from commercially available components relatively inexpensively using materials which complement and blend with the decor of the door. In addition, the locking assembly always is in a function position unless affirmative action is taken to disable it. Thus, the locking assembly can function whether the door is closed from the inside or the outside.

It will be apparent that various modifications can be made in the particular locking assembly described in detail above and shown in the drawings within the scope of the invention. For example, the size and configuration and materials of the bars and angle member can be changed for specific applications. Also, the lock-preventing means may be of a different design. Therefore, the invention is to be limited only by the following claims.

What is claimed is:

1. A locking assembly for a sliding door or window including an angle member disposed with a first flange section in a horizontal position normally and a second flange section extending downwardly therefrom in a vertical plane, a pair or rigid elongated bars connected to said second flange section below said first flange section with at least one being pivotally connected, said elongated bars being disposed normally in a horizontal position aligned longitudinally of each other with their adjacent ends spaced longitudinally along said second flange section, mounting brackets pivotally attached to the free ends of said elongated bars, and a loop member positionable to abut between the bottom of said first flange section and the top of said pivotally connected elongated bar selectively to prevent said elongated bars from being oriented in a longitudinally aligned locked position, said loop member being slidably disposed on said one of said elongated bars.

2. A locking assembly according to claim 1 wherein both of said elongated bars are pivotally connected to said second flange section.

3. A locking assembly according to claim 1 wherein the larger dimension of each flange section is along the length of said angle member.

4. A locking assembly according to claim 1 wherein said elongated bars are rectangular in cross section with the larger dimension parallel to said second flange section of said angle member.

5. A locking assembly according to claim 1 wherein said mounting brackets are angle brackets with flanges sections disposed in vertical planes.

6. A locking assembly according to claim 1 wherein said loop member is plastic.

7. A sliding door including the locking assembly of claim 1.

8. A sliding window including the locking assembly of claim 1.

* * * * *